US009950894B2

(12) United States Patent
Kast

(10) Patent No.: US 9,950,894 B2
(45) Date of Patent: Apr. 24, 2018

(54) DEVICE FOR RECEIVING AN ELASTOMER STRAND AND FOR FEEDING THE ELASTOMER STRAND TO A PROCESSING DEVICE

(71) Applicant: CQLT SaarGummi Technologies S.à.r.l., Remich (LU)

(72) Inventor: Christian Kast, Merzig-Brotdorf (DE)

(73) Assignee: CQLT SaarGummi Technologies S.à.r.l., Remich (LU)

( * ) Notice: Subject to any disclaimer, the term of this patent is extended or adjusted under 35 U.S.C. 154(b) by 178 days.

(21) Appl. No.: 14/780,618

(22) PCT Filed: Apr. 10, 2014

(86) PCT No.: PCT/EP2014/000958
§ 371 (c)(1),
(2) Date: Sep. 28, 2015

(87) PCT Pub. No.: WO2014/173499
PCT Pub. Date: Oct. 30, 2014

(65) Prior Publication Data

US 2016/0052746 A1 Feb. 25, 2016

(30) Foreign Application Priority Data

Apr. 22, 2013 (DE) ..... 10 2013 104 049

(51) Int. Cl.
*B65H 49/32* (2006.01)
*B65H 75/22* (2006.01)

(52) U.S. Cl.
CPC ..... *B65H 49/321* (2013.01); *B65H 49/322* (2013.01); *B65H 49/328* (2013.01);
(Continued)

(58) Field of Classification Search
CPC .. B65H 49/321; B65H 49/322; B65H 49/328; B65H 75/22; B65H 2701/534
See application file for complete search history.

(56) References Cited

U.S. PATENT DOCUMENTS 6,279,763 B1 8/2001 Bush
7,073,746 B2 7/2006 Lorenzo Barroso
(Continued)

FOREIGN PATENT DOCUMENTS

AT 199722 B 9/1958
CA 2295036 A1 * 1/1999 ..... B65H 75/22
(Continued)

OTHER PUBLICATIONS

Machine Translation of DE 10 2005 028 069 A1, May 11, 2006.*
International Search Report of PCT/EP2014/000958, dated Jul. 10, 2014.

*Primary Examiner* — William E Dondero
(74) *Attorney, Agent, or Firm* — Collard & Roe, P.C.

(57) ABSTRACT

A device for receiving an elastomer strand, in particular a sealing strand, that is to be conveyed to a processing location, and for feeding the elastomer strand at the processing location to a device for separating pieces from the elastomer strand and processing them, has a roll that receives the elastomer strand in the form of a coil, a conveying container that receives the roll with the coil and systems for rotating the roll within the conveying container in order to unwind the elastomer strand from the roll and feed it to the processing system. The conveying space required for the device after the elastomer strand has been unwound from the roll can be reduced.

11 Claims, 4 Drawing Sheets

(52) U.S. Cl.
CPC ..... *B65H 75/22* (2013.01); *B65H 2701/3914* (2013.01); *B65H 2701/534* (2013.01)

(56) References Cited

U.S. PATENT DOCUMENTS

| | | | | |
|---|---|---|---|---|
| 2003/0189128 | A1 | 10/2003 | Soepnel et al. | |
| 2013/0087652 | A1 | 4/2013 | Chastain et al. | |
| 2014/0299706 | A1* | 10/2014 | DiSabantonio, III .. | B65D 19/12 242/598 |

FOREIGN PATENT DOCUMENTS

| | | | |
|---|---|---|---|
| DE | 1 574 434 | A1 | 5/1971 |
| DE | 2 439 488 | A1 | 2/1975 |
| DE | 33 45 772 | A1 | 7/1984 |
| DE | 43 01 984 | A1 | 7/1994 |
| DE | 296 00 339 | U1 | 3/1996 |
| DE | 10 2004 007 188 | A1 | 8/2004 |
| DE | 10 2005 028 069 | A1 | 5/2006 |
| DE | 10 2008 003 504 | A1 | 7/2009 |
| EP | 1 350 752 | A2 | 10/2003 |
| FR | 2 938 520 | A1 | 5/2010 |
| JP | 2008-56304 | A | 3/2008 |

* cited by examiner

DEVICE FOR RECEIVING AN ELASTOMER STRAND AND FOR FEEDING THE ELASTOMER STRAND TO A PROCESSING DEVICE

CROSS REFERENCE TO RELATED APPLICATIONS

This application is the National Stage of PCT/EP2014/000958 filed on Apr. 10, 2014, which claims priority under 35 U.S.C. § 119 of German Application No. 10 2013 104 049.7 filed on Apr. 22, 2013, the disclosures of which are incorporated by reference. The international application under PCT article 21(2) was not published in English.

The invention relates to an apparatus for accommodation of an elastomer strand to be transported to a processing location, particularly a sealing strand, and for feed of the elastomer strand, at the processing location, to an apparatus that cuts partial pieces off the sealing strand and processes them, the apparatus having a roll that accommodates the elastomer strand in the form of a coil, a transport container that accommodates the roll with the coil, and having devices for rotating the roll within the transport container, unwinding the elastomer strand from the roll, and feeding it to the processing apparatus.

Figure 11:
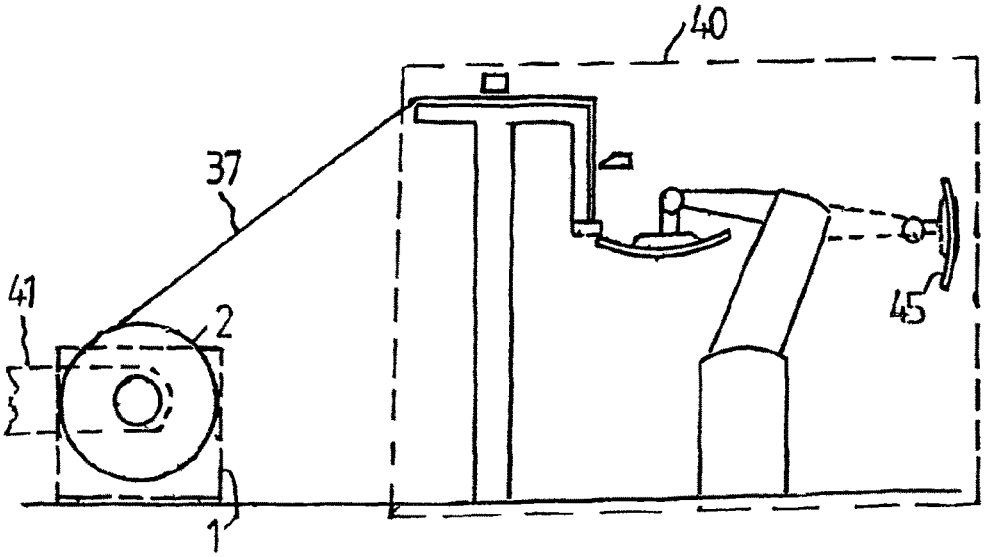

Such an apparatus, the characteristics of which are evident from FIG. 11, is known from DE 10 2005 028 069 A1. In the transport container of this known apparatus, the manufacturer supplies an elastomer strand 37 rolled up onto a roll 2, in each instance, to a vehicle manufacturer. At the vehicle manufacturer's location, seals on vehicle doors 45 are continuously formed from the elastomer strand 37, which is supplied in endless manner, by a processing apparatus 40. During transport to the manufacturer, the roll 2, with the elastomer strand 37 wound onto it, is mounted within the transport container 1 in torque-proof manner, on side walls of the transport container 1 that lie opposite one another. To wind the elastomer strand onto the roll 2 and to unwind it from the latter, and to feed the elastomer strand to the processing apparatus 40, a rotational drive and rotational mounting apparatus 41 engages on the roll 2 from the outside, in each instance.

The invention is based on the task of reducing the effort for transport of the apparatus between the production location and the processing location of the elastomer strand.

The apparatus that accomplishes this task, according to the invention, is characterized in that the transport space required for the apparatus can be reduced after the elastomer strand has been unwound off the roll.

It is advantageous that less transport capacity is required for return transport of the emptied apparatuses to the manufacturer of the elastomer strand material.

While reductions in the required transport space would be possible by means of nesting of parts of the emptied apparatuses into one another, in a preferred embodiment of the invention the apparatus can be reduced in size in at least one spatial dimension, particularly in its height.

It is practical if the apparatus can be stacked in the state of reduced size.

In an embodiment, the apparatus can be reduced in size by collapsing apparatus parts having a planar expanse, particularly by collapsing wall parts of the transport container.

While it would be possible to dispose of a hollow cylinder that forms the roll core of the roll, for example as a disposable part produced from cardboard, in a particularly preferred embodiment of the invention, such a hollow cylinder can be transformed into a planar form, which can be laid together with other planar apparatus parts to form a flat stack, in order to reduce the required transport space.

The hollow cylinder could be formed so as to be disassembled, from strands, such as rods, wires or cables, which extend along mantle lines of the hollow cylinder. Preferably, however, it is formed by a flexible strip that can be bent in the circumference direction of the hollow cylinder, the ends of which strip can be connected with one another.

In an embodiment, the roll has disk-shaped end caps, from which a cylinder stump projects on the face side, in each instance, engaging into the hollow cylinder, particularly when the hollow cylinder is formed.

The flexible strip can be wound onto the mantle surfaces of the cylinder stumps under tension, so that after the strip ends have been connected with one another, a stable hollow cylinder and thereby a stable roll core has been formed.

The flexible strip can consist of slats connected with one another in articulated manner, in the manner of a blind. Such slats can be glued onto a flexible layer composed of textile or plastic material, for example, or can themselves have articulation elements on their longitudinal sides, as rigid bodies.

It is practical if the flexible strip has projections on its edges, which projections face the end caps of the roll, for engagement into a guide in the end cap in question.

In particular, this guide can be formed by a groove in the mantle surface that is continuous over the circumference of the mantle surface of the cylinder stump of the end cap. The continuous groove allows any desired placement and tension stretching of the flexible strip on the mantle surface during the formation of the hollow cylinder.

It is practical if the devices for rotating the roll have elements for torque-proof coupling of the hollow cylinder to the end caps. Independent of the tension state of the flexible strip, it is ensured, in this way, that the roll core formed by the hollow cylinder constantly rotates along with the end caps, particularly with an end cap driven from the outside.

Figure 1:
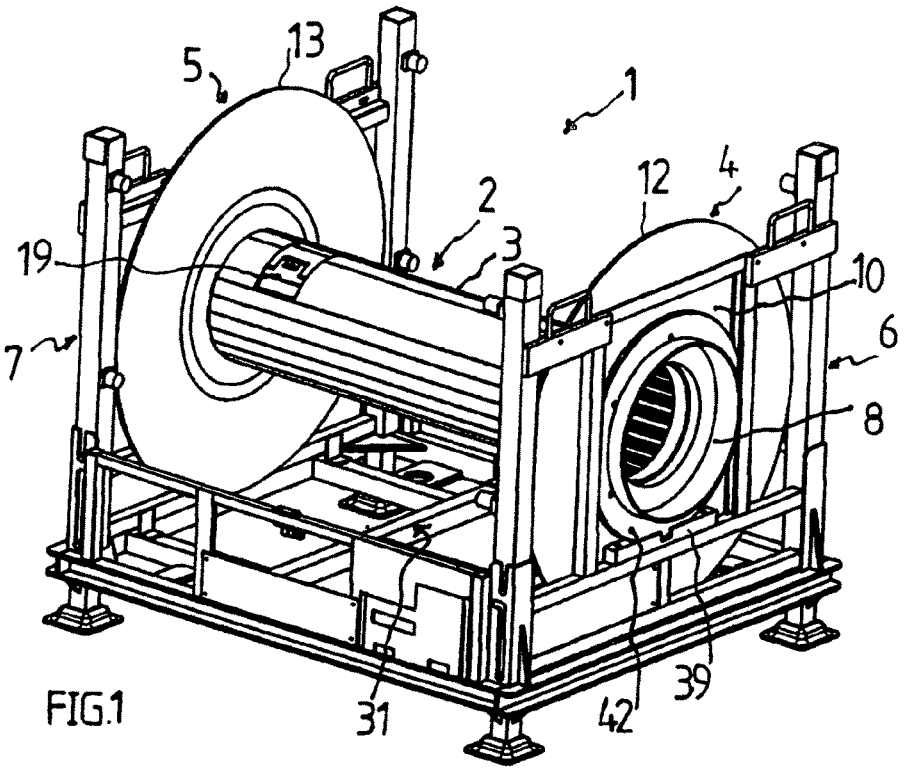
Figure 2:
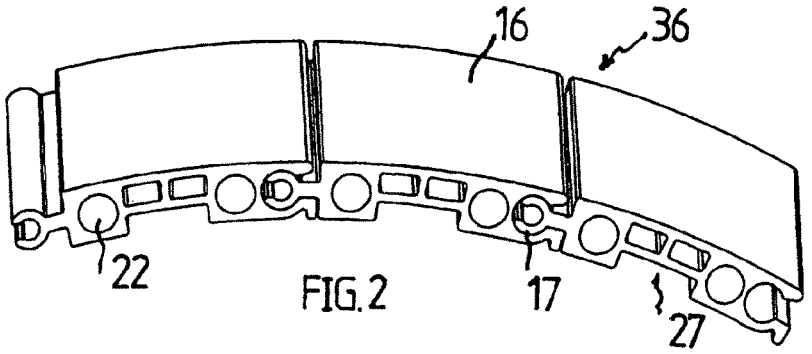
Figure 3:
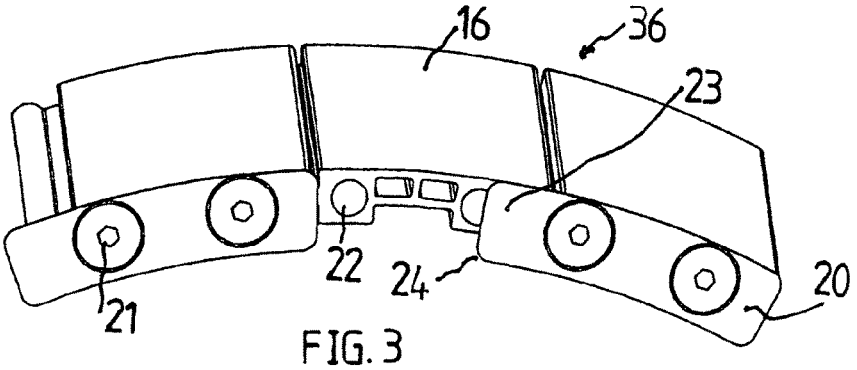
Figure 7:
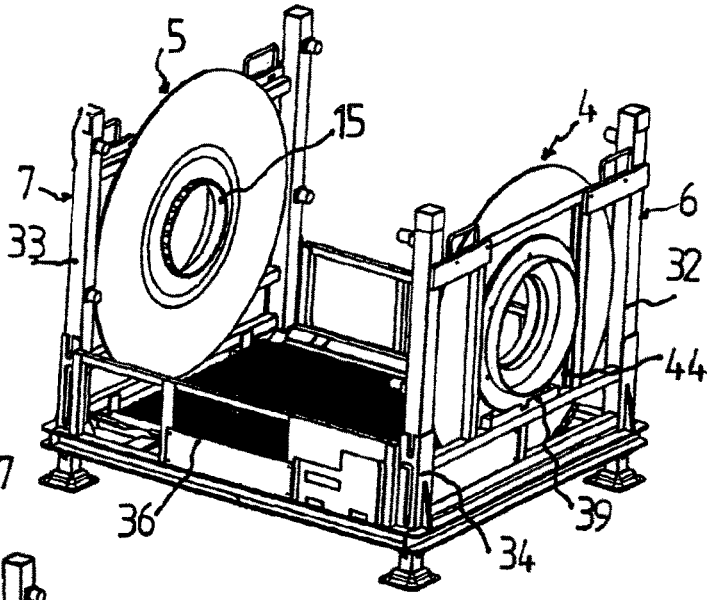
Figure 7A:
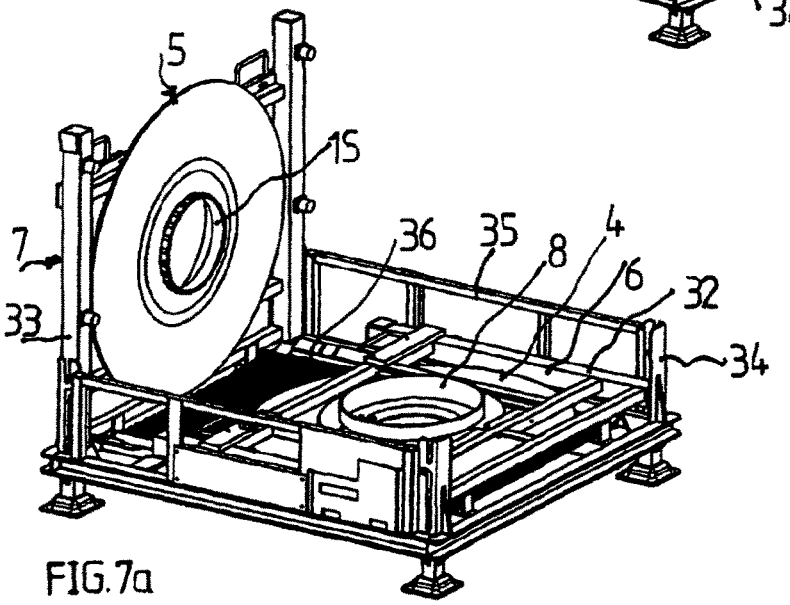
Figure 8:
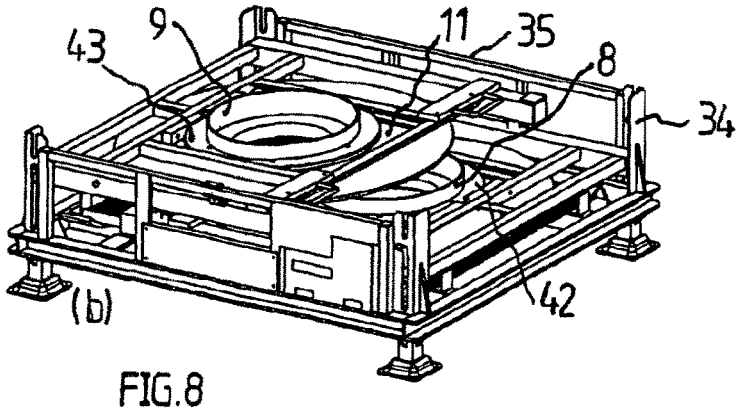
Figure 9:
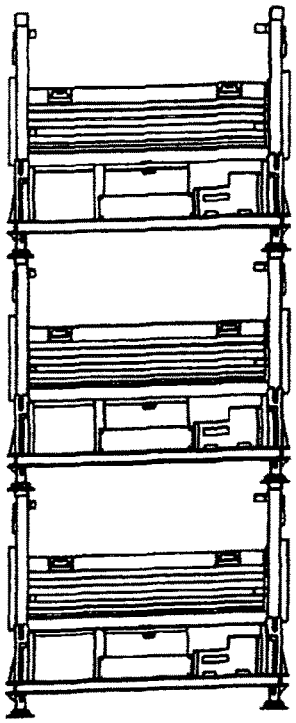
Figure 10:
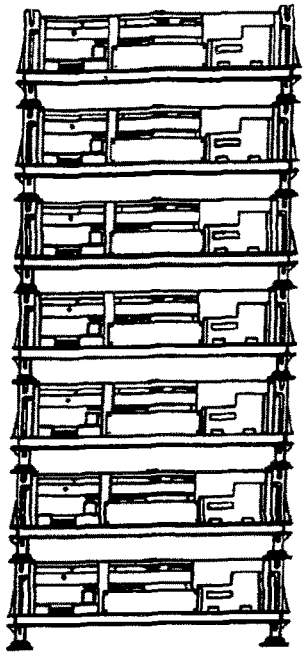

The invention will be explained in greater detail in the following, using exemplary embodiments and the attached drawings, which relate to one of these exemplary embodiments. The drawings show:

FIG. 1 an apparatus according to the invention, in a perspective view,

FIG. 2 a partial view of a section through a roll core of a roll used in an apparatus of FIG. 1, carrying an elastomer strand, FIG. 3 a partial view of the face end of the hollow-cylindrical roll core used in the apparatus of FIG. 1, FIGS. 4 to 6 detail views of the apparatus of FIG. 1, FIGS. 7 and 7*a* the apparatus of FIG. 1 in a partially collapsed state, FIG. 8 the apparatus of FIG. 1 in the completely collapsed state, FIG. 9 a stack of apparatuses according to FIG. 1, FIG. 10 a stack of apparatuses of FIG. 1, collapsed according to FIG. 8, FIG. 11 an apparatus according to the invention, which feeds an elastomer strand to a processing apparatus.

An apparatus for accommodation of an elastomer strand 37, produced by means of extrusion, shown in FIG. 11, has a frame-like container 1 formed essentially by rectangular tube parts, in which container a roll 2 that carries the elastomer strand 37 in the form of a coil is accommodated.

The roll 2 comprises a roll core configured as a hollow cylinder 3, as well as end caps 4 and 5 at the face ends of the hollow cylinder.

The roll 2 is mounted on opposite side walls 6 and 7 of the container 1, wherein a hollow cylinder stump 8 or 9 that projects outward from the end cap 4 or 5, respectively, coaxial to the hollow cylinder 3, engages into a frame opening 10 or 11, respectively (FIG. 8). The hollow cylinder stump 8 or 9 is vertically guided and held with shape fit in the frame openings 10, 11, and thereby the roll 2 is vertically guided and held with shape fit at its ends, in that a ring projection 42 or 43, in each instance, engages from the hollow cylinder stumps 8, 9 into a groove 44 (FIG. 7) into the shanks of the frame opening 10, 11 in question.

The hollow cylinder stump 8 or 9 projects from a disk 12 or 13, respectively, that furthermore forms the end cap 4 or 5. A further hollow cylinder stump 14 or 15 projects from the side of the disk 12 or 13 that faces away from the hollow cylinder stump 8 or 9. The hollow cylinder 3 that forms the roll core sits on the respective mantle surface 38 of the hollow cylinder stumps 14, 15, as is particularly evident from FIGS. 4 to 6.

From FIGS. 2 and 3, it is evident that the wall of the hollow cylinder 3 consists of slats 16, which are connected with one another in articulated manner at 17, in the manner of blind slats, and are produced from aluminum or plastic, for example. The slats form a flexible strip 36 that can be bent away in the circumference direction of the hollow cylinder 3. The ends of the strip 36 can be connected with one another at 18 and 19, by means of clamping elements.

As FIG. 3 shows, an end plate 20 is affixed at the ends of the strip 36 or of the hollow cylinder 3 that face the end caps 4, 5, at every second slat, in each instance, wherein pin connection elements 21 formed by screws, for example, engage into the slats, in channels 22 that open toward the face end of the slats 16. The end plates 20 that overlap every second slat at 23 prevent reciprocal displacement of the slats 16 in their longitudinal direction. Furthermore, the end plates 20 engage into a guide groove 25 in the mantle surface 38 of the hollow cylinder stump 14, 15 in question, with radial projections 24, so that the hollow cylinder wall formed by the clamping elements 18, 19 and the hollow cylinder stumps 14, 15 is connected with the end caps 4, 5 in stable manner.

Figure 4:
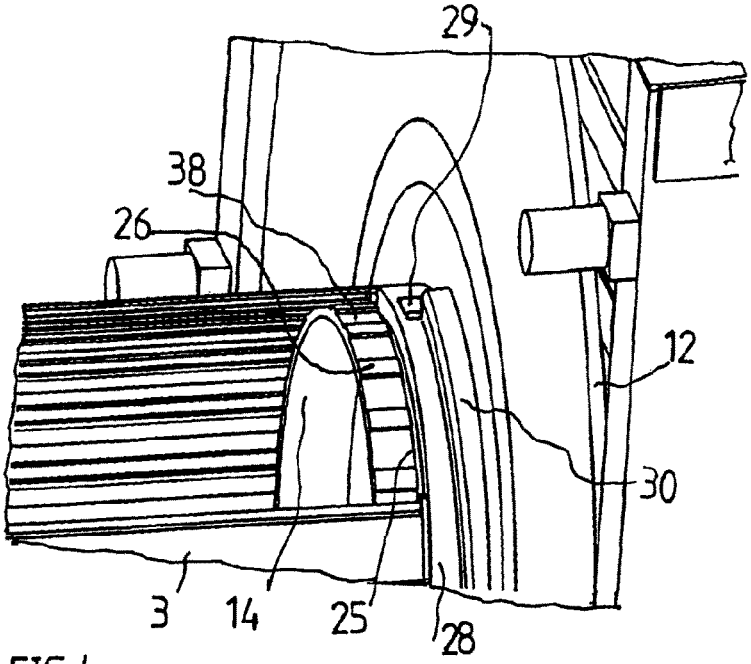
Figure 5:
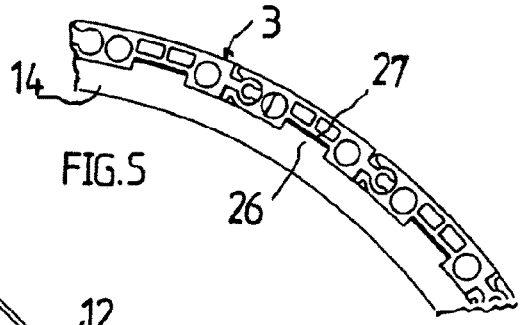
Figure 6:
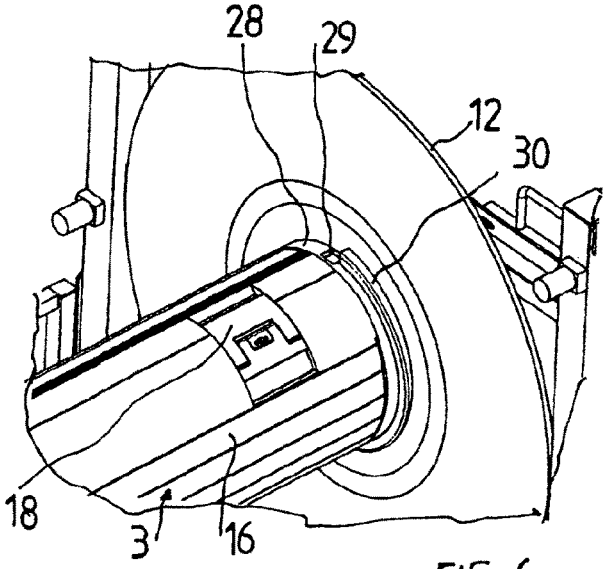

As FIGS. 4 and 5 furthermore show, projections 26, which project radially from the mantle surface 38 of the hollow cylinder stumps 14, 15, engage into a longitudinal groove 27 on each of the slats 16, in each instance.

The guide groove 25 mentioned above borders on a ring shoulder 28, the height of which approximately corresponds to the thickness of the wall of the hollow cylinder 3. In this way, a winding surface for accommodation of the elastomer strand 37, which surface is continuous, without steps, all the way to the disk 12 or 13 of the end cap 4 or 5, is formed. The end of the elastomer strand 37 can be introduced into an opening 29. A wedge 30 that runs on the ring shoulder 28 over an angle of 180° 7 fills a cavity, in a first winding layer, which cavity would otherwise occur when the elastomer strand, the end of which is held in place in the opening 29, is wound on in spiral shape.

In the position shown in FIG. 1, the roll 2 lies in the frame openings 10, 11, in torque-proof manner, on the lower shank of the frame openings 10, 11, where a lining 39 having a high friction coefficient is provided, in each instance. Both for winding up and for unwinding of the elastomer strand 37 from the roll 2, a mounting and drive apparatus 41 shown in FIG. 11 is used, which apparatus engages into the hollow cylinder stump 8 and 9 in question at both face ends of the roll, and raises the roll 2, so that it can be rotated on engagement elements of the mounting and drive apparatus 41. A rotational movement that brings about winding-up and unwinding of the elastomer strand is transferred to the roll 2 by way of one of the engagement elements or both.

After complete unwinding of the elastomer strand 37, which has a length of over 1000 m in the exemplary embodiment shown, from the roll 2, at the processing location of the elastomer strand, the apparatus described above is brought into a state of reduced size for return transport, with the height being reduced.

First, according to FIG. 7, removal of the hollow cylinder 3 takes place, in that the clamping devices 18, 19 are released, and the flexible strip 36 that forms the hollow cylinder 3 is unwound from the hollow cylinder stumps 14, 15. The unwound strip 36 can then be laid down onto a bottom 31 of the container 1 formed by struts in space-saving manner, as is evident from FIG. 7.

To further reduce the size of the apparatus, upper parts 32, 33 of the side walls 6, 7, connected with the end caps 4, 5 [comma removed] with shape fit, are lifted out upward, and, according to FIG. 8, laid down onto the bottom 31 of the container 1 above the strip 36, just like the strip 36. The apparatus parts laid down in this manner remain within the height of plug-in bases 34 that accommodate the upper parts 32, 33 of the side walls 6, 7, which bases are connected with one another on the longitudinal side, at a distance from the bottom 31, by way of transverse struts 35. The upper parts or side walls could also be connected with the remaining container by way of articulations, and structured so as to fold down in the direction of the container bottom. Thereby even stronger cohesion of all of the parts that make up the apparatus is secured in the case of an impact effect in the event of an accident.

Just as the apparatuses according to FIG. 9, which have not been reduced in size, can be stacked, the apparatuses that are reduced in size can also be stacked, as FIG. 10 shows. In the example shown, a total of seven apparatuses reduced in size can be stacked within the height of three stacked apparatuses not reduced in size, in the example shown.

The invention claimed is:

1. Apparatus for accommodation of an elastomer strand to be transported to a processing location and for feed of the elastomer strand, at the processing location, to an apparatus that cuts partial pieces off the elastomer strand and processes them, the apparatus having a roll that accommodates the elastomer strand in the form of a coil, wherein the roll comprises a hollow cylindrical roll core which is configured to be unwound into a planar form, a transport container that accommodates the roll with the coil, the transport container comprising a plug-in base and wall parts, the plug-in base comprising a bottom and having a height, and devices for rotating the roll within the transport container, unwinding the elastomer strand from the roll, and feeding it to the processing apparatus, wherein the transport container is configured to release the roll and the wall parts are configured to be collapsible into collapsed wall parts, wherein a transport space required for the apparatus can be reduced in height after the elastomer strand has been unwound off the roll by unwinding the roll core into the planar form and collapsing the wall parts and laying down the collapsed wall parts and the roll core in the planar form on the bottom of the transport container such that the roll core in the planar form and the collapsed wall parts remain within the height of the plug-in base, and wherein the apparatus reduced in height can be stacked.

2. Apparatus according to claim 1, wherein the hollow cylindrical roll core is formed so as to be disassembled, from strands that extend along mantle lines of the hollow cylinder, or formed by a flexible strip that can be bent in the circumference direction of the hollow cylinder, the ends of which strip can be connected with one another.

3. Apparatus according to claim 2, wherein the flexible strip can be wound onto mantle surfaces of cylinder stumps under tension.

4. Apparatus according to claim 2, wherein the flexible strip is formed from slats connected with one another in articulated manner.

5. Apparatus according to claim 1, wherein the roll has disk-shaped end caps, from which cylinder stump projects, in each instance, engaging into the hollow cylindrical roll core.

6. Apparatus according to claim 5, wherein the flexible strip has projections on its edges, which projections face the end caps, for respective engagement into guides in the end caps.

7. Apparatus according to claim 6, wherein the guide is formed by a groove in a mantle surface of a hollow cylinder stump, and wherein the groove is continuous over a circumference of the mantle surface.

8. Apparatus according to claim 5, wherein the devices for rotating the roll comprise elements for torque-proof coupling of the hollow cylindrical roll core to the end caps.

9. Apparatus according to claim 5, wherein the end caps are rotationally connected with one of two opposite side walls of the container, in each instance, wherein the end caps are configured to be turned down with the side walls onto the bottom of the container and held in position upon re-assembly of the apparatus.

10. A method for reducing transport space for an apparatus for accommodation of an elastomer strand, wherein the elastomer strand is to be transported to a processing location and fed at the processing location to an apparatus that cuts partial pieces off the elastomer strand and processes them, the method comprising:

(a) providing an apparatus having a roll that accommodates the elastomer strand in the form of a coil, wherein the roll comprises a hollow cylindrical roll core which is configured to be unwound into a planar form, a transport container that accommodates the roll with the coil, the transport container comprising a plug-in base and wall parts, the plug-in base comprising a bottom and having a height, and devices for rotating the roll within the transport container, unwinding the elastomer strand from the roll, and feeding it to the processing apparatus, (b) unwinding the elastomer strand off the roll, (c) releasing the roll from the transport container, unwinding the roll core into the planar form, and collapsing the wall parts into collapsed wall parts, (d) laying down the collapsed wall parts and the roll core in the planar form on the bottom of the transport container such that the roll core in the planar form and the collapsed wall parts remain within the height of the plug-in space to reduce in height the transport space required for the apparatus after the elastomer strand has been unwound off the roll.

11. The method according to claim 10, wherein the roll has disk-shaped end caps, from which a cylinder stump projects, in each instance, engaging into the hollow cylindrical roll core, wherein the end caps are rotationally connected with one of two opposite side walls of the container, in each instance, and wherein the method further comprises turning down the end caps with the side walls onto the bottom of the container and holding the end caps in position upon re-assembly of the apparatus.

* * * * *